United States Patent [19]

Sicurella

[11] 4,075,772

[45] Feb. 28, 1978

[54] INSOLE FOR FOOTWEARS

[75] Inventor: MariaRosa Sicurella, Parabiago, Milan, Italy

[73] Assignee: Amilcare Cavalieri, Italy

[21] Appl. No.: 569,620

[22] Filed: Apr. 21, 1975

[51] Int. Cl.[2] ..... A43B 13/38

[52] U.S. Cl. ..... 36/43; 36/11.5

[58] Field of Search ..... 36/43, 32 R, 11.5

[56] References Cited

U.S. PATENT DOCUMENTS

| | | | |
|---|---|---|---|
| D. 185,462 | 6/1959 | Ratner | 36/32 R X |
| 1,167,885 | 1/1916 | Carll | 36/32 R |
| 2,527,414 | 10/1950 | Hallgren | 36/32 R |
| 2,930,149 | 3/1960 | Hack et al. | 36/32 R X |

FOREIGN PATENT DOCUMENTS

| | | | |
|---|---|---|---|
| 1,511,344 | 12/1967 | France | 36/43 |
| 1,546,521 | 10/1968 | France | 36/32 R |
| 61,951 | 5/1968 | Germany | 36/43 |
| 942,294 | 5/1956 | Germany | 36/43 |

*Primary Examiner*—Alfred R. Guest
*Attorney, Agent, or Firm*—Fleit & Jacobson

[57] ABSTRACT

An insole for general footwears or shoes, having a plurality of undulating tabs, substantially arranged transversely of the longitudinal axis of the sole, and defining a bearing surface for the foot sole.

4 Claims, 4 Drawing Figures

INSOLE FOR FOOTWEARS

This invention relates to an insole made of plastics material, provided with self-massaging tabs, said tabs or fins being arranged and shaped at varying heights to accommodate the anatomical shape of a foot sole.

Known are rigid anatomical insoles as applied to general footwears or shoes, as well as self-massaging insoles having the surface thereof comprising a plurality of resilient cylindrical pegs or posts defining the supporting surface for the foot sole.

However, due to the provision of resilient pegs or posts, this latter type of insole has a remarkable discontinuity in the foot supporting surface, with a resulting physical trouble after some period of time; furthermore, being such pegs or posts flexible in any direction, as a result the pegs or posts along the sole edges may outwardly bend not supporting or unevenly supporting the foot sole; thus, the sole would lose its anatomical shape or configuration and accordingly most of its effects.

The object of the present invention is to provide an anatomical insole avoiding the above mentioned disadvantages, capable of supporting and perfectly accommodating the foot sole.

According to the invention, the insole has its foot sole bearing surface shaped or configurated with a plurality of resilient flexible tabs or fins, substantially arranged transversely of the longitudinal center line of the insole. Thus, owing to the increased transverse dimension relative to the width thereof, such tabs or fins cannot be laterally deflected, correctly supporting the foot.

Preferably, the tabs or fins are arranged in alignment relationship according to a plurality of longitudinal rows, with the tabs or fins in one row having varying width and different height for better accommodating the anatomical configuration of the foot sole. Sometimes, it may be advantageous a slight amount of convergency or inclination for the tabs or fins relative to the longitudinal axis of the insole for better accommodating the various requirements.

Figure 1:
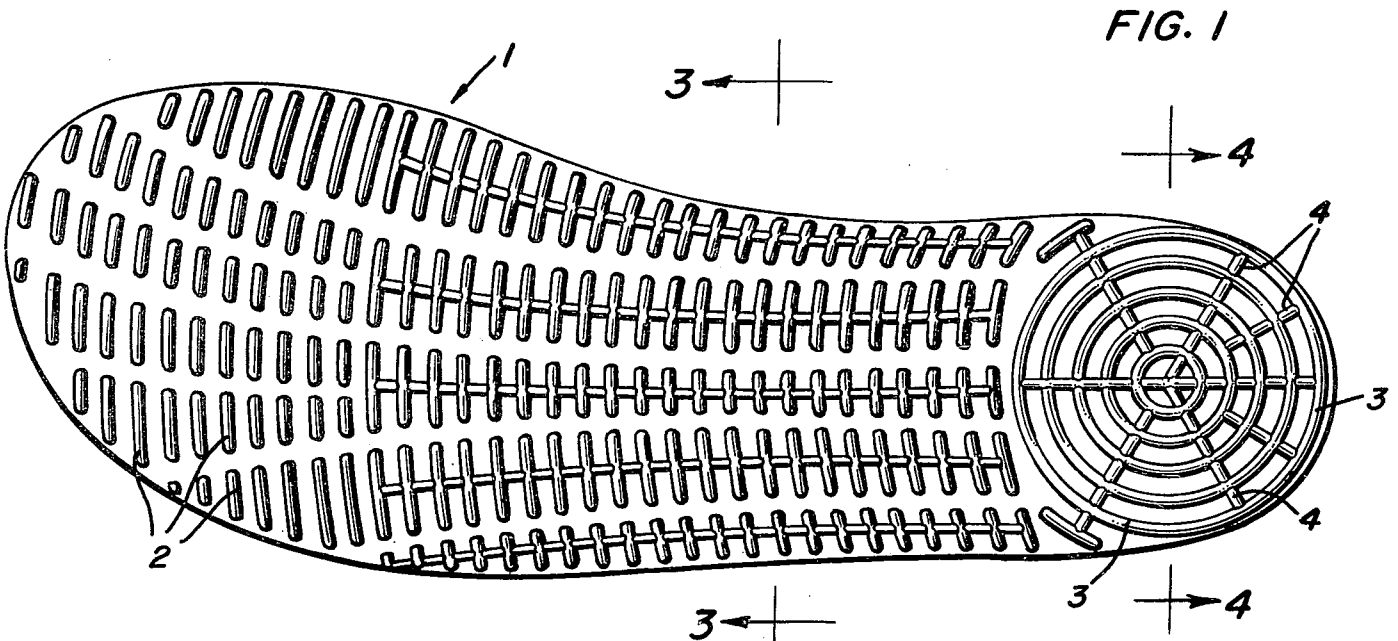
FIG. 1 is a top plan view of the insole.
Figure 2:
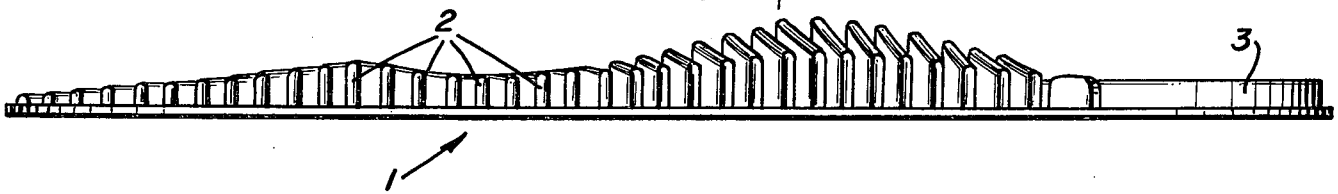
FIG. 2 is a side view of the insole.
Figure 4:
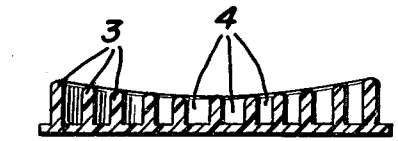
FIG. 4 is a sectional view on the line 4—4 of FIG. 1.
Figure 3:
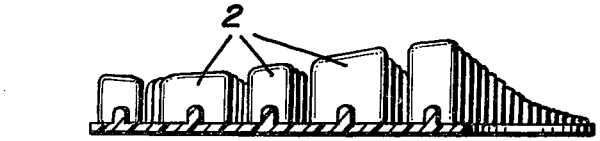
FIG. 3 is a sectional view on the line 3—3 of FIG. 1.

An insole, as designed at a whole at 1, is made of plastics material having some degree of elasticity and softness; as shown by the drawings, its top foot sole bearing surface comprises a plurality of tabs or fins 2 which, at that in portion from the heel to the toe, are substantially arranged transversely of the longitudinal axis of the sole.

Said tabs or fins 2 are of gradually increasing or decreasing height in order to accommodate the anatomical shape of the foot sole, while providing an extended bearing surface for the foot.

Flexibility and undulation imparted to such tabs or fins when walking provided a beneficial self-massaging effect to the sole of the foot, the latter being correctly supported.

In some circumstances, the self-massaging effect can be improved by causing a slight forward convergency of the tabs or fins, as well as towards the sole center line, as shown.

In the accompanying drawings, said tabs or fins 2 are arranged in alignment relationship according to a plurality of rows longitudinally of the insole and having varying width; however, it is apparent that such tabs or fins could be also differently arranged or formed and could even be also continuous from one to the other side of the insole.

From the accompanying drawings, it will be seen that on the other hand and optionally at the insole zone related to the heel, undulating tabs or fins 2 have been provided, these tabs or fins being arranged according to concentric circles, with the tabs or fins of one circle connected at one or more locations to the tabs or fins of the adjoining circles by means of radial webs 4; thus, an increased stability is given to the tabs or fins of the heel zone, while being still provided with their self-massaging effect.

Therefore, an insole thus obtained can be applied to any type of footwear, such as to wooden-shoes, leather shoes, or any other type of purposely arranged footwear or shoe.

I claim:

1. An insole for human footwear having defined thereon a first area corresponding to the heel of the foot and a second area corresponding to the remaining part of the foot, said first area having a plurality of upwardly protruding concentric rings of varying height to accommodate the anatomical form of the heel, and said second area having a plurality of upwardly protruding tabs of varying height each positioned substantially transversely to the longitudinal axis of the sole and aligned in rows parallel to said axis, the height of the tabs defining a bearing surface to accommodate the anatomical configuration of the foot.

2. The insole of claim 1 further comprising a plurality of radially arranged protruding elements located in said first defined area and abutting said protruding concentric rings.

3. The insole of claim 1 wherein said second area further defines a third and fourth areas, said third area corresponding to the arch of the foot, said third area having alignment ribs of a height less than the lowest tab in said third area, said alignment ribs arranged to transversely abut each tab in said third portion to partially limit said tabs from freely moving forwards or backwards in the direction of the longitudinal axis of the sole.

4. The insole of claim 3 wherein the tabs in said fourth area located most distant from the longitudinal axis of the sole are of a width substantially greater than those tabs located proximate said axis.

* * * * *

UNITED STATES PATENT OFFICE

CERTIFICATE OF CORRECTION

Patent No. 4,075,772 Dated February 28, 1978

Inventor(s) MariaRosa Sicurella

It is certified that error appears in the above-identified patent and that said Letters Patent are hereby corrected as shown below:

The term of this patent subsequent to January 28, 1994, has been disclaimed.

Signed and Sealed this

Second Day of May 1978

[SEAL]

Attest:

RUTH C. MASON
Attesting Officer

LUTRELLE F. PARKER
Acting Commissioner of Patents and Trademarks